United States Patent [19]

Creutz, deceased et al.

[11] 4,207,150

[45] Jun. 10, 1980

[54] ELECTROPLATING BATH AND PROCESS

[75] Inventors: Hans G. Creutz, deceased, late of Yale, Mich., by Katharina A. Creutz, administratrix; Sylvia Martin, Detroit, Mich.; Debra J. Saez, Madison, Wis.; Roy W. Herr, Troy, Mich.

[73] Assignee: Oxy Metal Industries Corporation, Warren, Mich.

[21] Appl. No.: 39,403

[22] Filed: May 15, 1979

Related U.S. Application Data

[63] Continuation-in-part of Ser. No. 872,190, Jan. 25, 1978, abandoned.

[51] Int. Cl.[2] ..... C25D 3/22

[52] U.S. Cl. ..... 204/55 R

[58] Field of Search ..... 204/55 R, 43 Z

[56] References Cited

U.S. PATENT DOCUMENTS

| | | | |
|---|---|---|---|
| 3,318,787 | 5/1967 | Rindt et al. | 204/55 Y |
| 3,769,184 | 10/1973 | Rushmere | 204/55 R |
| 3,823,076 | 7/1974 | Rushmere | 204/55 R |
| 3,909,373 | 9/1975 | Creutz | 204/55 R |
| 4,071,418 | 1/1978 | James | 204/55 R |
| 4,071,419 | 1/1978 | James | 204/55 R |

*Primary Examiner*—G. L. Kaplan

*Attorney, Agent, or Firm*—Richard P. Mueller

[57] ABSTRACT

A non-cyanide zinc electroplating bath containing an effective brightening and leveling amount of a leveling and brightening agent comprising a bath soluble butyl nicotinate sulfate or sulfonated quaternary salt. The electroplating bath may further advantageously incorporate an effective brightening amount of a polyether compound as a supporting brightening agent and an effective leveling amount of methane sulfonic acid and salts thereof as a supporting leveling agent. The improved leveling of the bright electrodeposited zinc plate in accordance with the process aspects is attained over a relatively broad range of pH from about 2.0 to 7.5, and current density.

8 Claims, No Drawings

ELECTROPLATING BATH AND PROCESS

This is a continuation-in-part of application Ser. No. 872,190 filed Jan. 25, 1978, now abandoned.

BACKGROUND OF THE INVENTION

Because of its effectiveness and comparatively low cost, zinc plating has received wide spread commercial application for the corrosion protection of ferrous substrates and also as a decorative finish. Zinc electroplating baths and processes of the types heretofore known have incorporated various brighteners to enhance the brightness of the deposited zinc plate further enhancing the appearance of the plated article. While such prior art compositions and techniques have been effective in producing relatively bright zinc deposits, a continuing problem has been the lack of achieving a desired degree of leveling or smoothness of the deposit. This problem is further aggravated by the fact that such bright zinc deposits are frequently applied on surfaces of articles which are relatively unfinished, rough and uneven thereby further magnifying surface roughness.

The improved non-cyanide zinc electroplating bath composition and process of the present invention provides for a leveling heretofore unattainable with bath compositions and processes previously known, and further provides a smooth, bright and adherent zinc plating deposit of excellent corrosion and aesthetic appearance.

SUMMARY OF THE INVENTION

The benefits and advantages of the present invention are achieved by a non-cyanide zinc electroplating bath composition of the so-called acid or neutral type adapted to operate over a pH range of from about 2.0 to about 7.5 which contains a controlled amount, effective to provide leveling and brightening, of a primary leveling and brightening agent comprising a bath soluble butyl nicotinate quaternary salt of the formula:

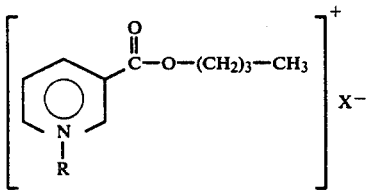

Wherein:

R is $CH_3$, $C_2H_5$ or $C_6H_5CH_2$, and

X is $R—O—SO_3$ or $R—SO_3$

These butyl nicotinate quaternary salts are effective when employed in amounts as low as about 0.5 mg/l and can be employed in concentrations as high as about 10.0 g/l depending upon the specific bath composition and the presence and concentration of supplemental supporting agents used.

In accordance with a preferred embodiment of the composition and process of this invention, the use of the leveling and brightening agent in acid zinc chloride electroplating baths is further enhanced by the addition of controlled amounts of polyethers as a supporting brightener agent and controlled effective amounts of methane sulfonic acid and the salts thereof as a supplemental supporting leveling agent. When operating the zinc plating bath a pH's generally above about 6.8, an organic chelating agent may advantageously be incorporated to prevent zinc metal from precipitating from the bath.

In accordance with the process aspects of the present invention, smooth, bright and adherent zinc deposits on metal substrates are attained by subjecting the articles to an electroplating bath composition incorporating the aforementioned butyl nicotinate quaternary salt at temperatures ranging from about 60° F. to about 140° F. and at current densities broadly ranging from about 5 ASF up to about 200 ASF.

Additional benefits and advantages of the present invention will become apparent upon a reading of the description of the preferred embodiments taken in conjunction with the specific examples herein provided.

DESCRIPTION OF THE PREFERRED EMBODIMENTS

The improved electroplating bath of the present invention comprises an aqueous, cyanide-free, neutral or acid-type zinc electroplating bath having a pH ranging from about 2.0 up to about 7.5 incorporating the butyl nicotinate quaternary salt in an effective amount in addition to appropriate amounts of other conventional constituents employed in acid zinc baths. In accordance with conventional practive, the bath comprises an aqueous solution containing an aqueous soluble zinc salt, such as zinc sulfate, zinc chloride, zinc fluoroborate, zinc acetate or the like as well as mixtures thereof to provide a concentration of zinc ranging from about 5.0 up to approximately 105 g/l with concentrations of zinc from about 5.0 to about 70 g/l being preferred.

In accordance with conventional practice, the aqueous solution may further contain inert salts for improving the conductivity of the bath such as sodium chloride, potassium chloride, ammonium chloride, ammonium sulfate, magnesium chloride, magnesium sulfate and the like which are employed in concentrations ranging from about 1.0 g/l up to approximately 500 g/l. In addition to the foregoing any one of a variety of wetting agents in accordance with conventional practice can also be satisfactorily employed with concentrations thereof typically ranging from about 0.1 up to about 30 g/l. Buffering agents of the types also conventionally employed in commercial practice can also be advantageously employed such as boric acid or its salts, acetic acid or its salts, or like compounds which are typically present in concentrations of from about 0.5 up to approximately 100 g/l.

In addition to the foregoing conventional constituents, the improved bright zinc electroplating bath incorporates a controlled amount, effective to provide leveling and brightening, of a primary leveling and brightening agent comprising a butyl nicotinate quaternary salt of the formula:

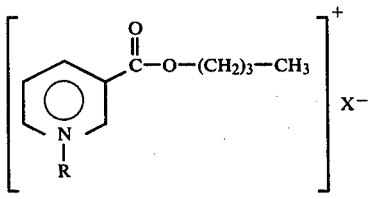

Wherein:

R is $CH_3$, $C_2H_5$ or $C_6H_5CH_2$, and

X is R—O—$SO_3$ or R—$SO_3$

The butyl nicotinate quaternary salt as the primary leveling and brightening agent is employed in concentrations as low as about 0.5 mg/l to amounts as high as about 10 g/l, while concentrations ranging from about 10 mg/l to about 100 mg/l are preferred in most instances. Included among the primary leveling agents which have provided satisfactory performance are, butyl nicotinate dimethyl sulfate quaternary, butyl nicotinate methyl methane sulfonate quaternary, butyl nicotinate diethyl sulfate quaternary, butyl nicotinate p-methyl tosylate quaternary and the like.

Surprisingly, when this primary leveling and brightening agent is used alone, an excellent, bright zinc plate is obtained over a broad range of current densities and over the entire bath pH range of about 2.0 to 7.5. This zinc electroplate also is found to have superior leveling properties. This is in contrast to the prior art disclosures which teach that, within this pH range, such results can only be obtained with similar halide quaternaries when they are used in combination with other brightening and leveling agents.

Although, acceptable plating results can thus be obtained when the quaternaries of the present invention are used without other brightening and leveling agents, in some instances even greater enhancement of the brighteness and leveling characteristics of the zinc electroplate can be obtained by using this primary leveling and brightening agent in combination with one or more secondary or supporting brighteners and/or leveling agents. In such instances, the aqueous plating solution may contain an effective brightening amount of secondary or brighteners such as a polyether having a molecular weight ranging from about 100 up to about 1,000,000 and selected from the group consisting of polyalkylene glycols, polyethylene glycols, polypropylene glycols, polyglycidols, ethoxylated phenols, ethoxylated naphthols, ethoxylated acetylenic glycols, ethoxylated olefin glycols, and mixtures thereof. Such secondary brightener can advantageously be employed in amounts ranging from about 0.25 up to approximately 20 g/l. Particularly satisfactory results have been obtained in acid zinc chloride plating baths employing a secondary polyether brightener comprising acetylenic glycol 2,3,7,9-tetramethyl-5-decyne-4, 7 diol-ethoxylated, or ethoxylated naphthol.

Additionally, the use of an effective leveling amount of a secondary leveling agent may further enhance the improved leveling effectiveness of the bath. Typical of such secondary leveling agents which may be used are methane sulfonic acid as well as salts thereof including sodium salt, potassium salt, magnesium salt, zinc salt, and the like. The secondary methane sulfonic acid leveling agent can be employed in amounts ranging from about 0.005 up to about 5.0 g/l, with concentrations of about 0.05 to about 0.02 g/l being satisfactory in most instances.

The pH operating range from about 2.0 to about 7.5 of the plating bath can be adjusted by the addition of sulfuric acid to the sulfate or sulfate-chloride baths and hydrochloric acid to the chloride baths. Such adjustments may be facilitated by the addition of conventional buffering agents as well. In situations where the bath pH operating range is above about 6.8, a suitable organic chelating agent is advantageously employed such as NTA, EDTA, citric acid, or the like in amounts conventionally ranging from approximately 0.5 up to about 250 g/l. Such chelating agents help prevent the zinc metal ions from precipitating out of the bath in this higher pH range.

The advantages of the bath composition of the present invention are attainable in accordance with its process aspects employing barrel, tank as well as continuous plating facilities and equipment. In such processes, the bath solution can be satisfactorily employed at temperatures ranging from about room temperature up to about 140° F. with temperatures of from about 60° F. to about 90° F. being specifically preferred.

In order to further illustrate the present invention, the following specific examples are provided. It will be understood that the examples are provided for illustrative purposes and are not intended as being restrictive of the present invention as herein described and as set forth in the subjoined claims.

EXAMPLE 1

A J-shaped steel test specimen was plated for a period of 15 minutes at a current density of 40 ASF employing an aqueous plating bath having the composition as follows:

| Constituent | Concentration, g/l |
|---|---|
| Zinc chloride | 60 |
| Potassium Chloride | 195 |
| Boric Acid | 30 |
| 2,3,7,9 Tetramethyl 5-decyne 4,7 diol-30 moles ethoxylated | 5 |
| Butyl nicotinate dimethyl sulfate quaternary | 0.03 |

The pH of the plating bath was 5.8. The J-shaped steel test specimen upon completion of plating had a smooth uniform bright zinc electrodeposit.

EXAMPLE 2

An aqueous plating bath was formulated containing the following components in the amounts indicated:

| Constituent | Concentration g/l |
|---|---|
| Zinc Chloride | 50 |
| Potassium Chloride | 225 |
| Boric Acid | 27 |
| Benzoic Acid | 3 |
| 2,3,7,9 Tetramethyl-5 decyne 4, 7 diol-30 moles ethylated | 4.5 |
| Butyl nicotinate diethyl sulfate quat. | 0.004 |

A J-shaped steel test specimen was plated for a period of 10 minutes at current density of 35 ASF employing the bath composition as above. The pH of the plating bath was 5.6. The J-shaped steel test specimen upon completion of plating had a smooth uniform bright zinc electrodeposit.

EXAMPLE 3

A J-shaped steel test specimen was electroplated at a current density of 30 ASF for a period of 20 minutes in an aqueous bath having the following composition, at a pH of 5.5:

| Constituent | Concentration g/l |
|---|---|
| Zinc Chloride | 50 |
| Ammonium Chloride | 100 |

-continued

| Constituent | Concentration g/l |
|---|---|
| Ethoxylated B-naphthol (avg. MW 900) | 10 |
| Butylnicotine N-methyl Tosylate quaternary | 0.07 |

The electroplating specimen had a smooth bright zinc electrodeposit on the surface thereof.

EXAMPLE 4

A J-shaped steel test specimen was electroplated at a current density of 30 ASF for a period of 20 minutes in an aqueous bath having the following composition, at a pH of 5.5:

| Constituent | Concentration g/l |
|---|---|
| Zinc Chloride | 50 |
| Ammonium Chloride | 100 |
| Ethoxylated B-naphthol (Avg. MW 900) | 10 |
| Butylnicotine dimethyl sulfate quaternary | 0.06 |

The electroplated specimen had a smooth bright zinc electrodeposit on the surface thereof.

EXAMPLE 5

By way of comparison, three aqueous electroplating baths A B & C were formulated containing the following components in the amounts indicated:

| Constituent | Concentration g/l |
|---|---|
| Zinc Chloride | 60 |
| Potassium Chloride | 205 |
| Boric Acid | 30 |
| 2,3,7,9 Tetramethyl 5-decyne 4,7 diol-30 moles ethoxylated | 4.8 |
| Nicotinate quarternary | 8 mg/l |
| The pH of these bath was 5.5 | |

In bath A, the nicotinate quaternary was nicotinic acid benzyl chloride quaternary. In bath B, the nicotinic quaternary was butyl nicotinate benzyl chloride quaternary. In bath C, the nicotinate quaternary was butyl nicotinate dimethyl sulfate quaternary.

Panels were plated in a Hull cell in each of the three baths at 2 amperes for 10 minutes over a current density range of 0–90 amps per square foot and the following results were obtained:

Bath A - The panel had completely black burned above 24 ASF. The remainder of the panel was semi-bright after chromating, although before chromating, the semi-bright area was much more dull.

Bath B - The panel was burned above 60 ASF and had a cloud between 35–20 ASF and an even more pronounced cloud at 12–4 ASF.

Bath C - The panel was bright all the way acrossed with only a very slight cloud at 12 ASF.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. An aqueous non-cyanide zinc electroplating bath having a pH of from about 2.0 to about 7.5 containing an amount, effective to provide leveling and brightening, of a primary leveling and brightening agent comprising a bath soluble butyl nicotinate quaternary salt of the formula:

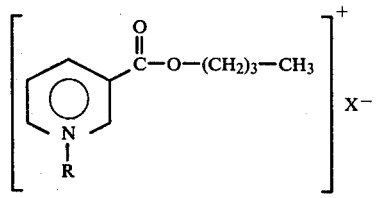

Wherein:

R is $CH_3$, $C_2H_5$ or $C_6H_5CH_2$, and

X is $R—O—SO_3$ or $R—SO_3$

2. An electroplating bath as defined in claim 1, in which there is included an effective brightening amount of a polyether compound as a supporting brightening agent.

3. An electroplating bath as defined in claim 2, in which the polyether compound is selected from the group consisting of polyalkylene glycols, polyethylene glycols, polypropylene glycols, polyglycidols, ethoxylated phenols, ethoxylated naphthols, ethoxylated acetylenic glycols, ethoxylated olefin glycols, and mixtures thereof.

4. An electroplating bath as defined in claim 1, in which there is included an effective leveling amount of methane sulfonic acid and salts thereof as a supporting leveling agent.

5. An electroplating bath as defined in claim 1, in which there is included effective brightening amounts of a polyether compound as a brightening agent and effective leveling amounts of methane sulfonic acid and salts thereof as a supporting leveling agent.

6. An electroplating bath as defined in claim 5, in which the butyl nicotinate quaternary salt is present in the amount of about 0.5 mg/l to approximately 10.0 g/l, the polyether compound is present in an amount ranging from 0.25 to 20.0 g/l approximately, and the methane sulfonic acid is present in an amount ranging from about 0.005 to approximately 5.0 g/l.

7. An electroplating bath as defined in claim 1, in which the butyl nicotinate quaternary salt is selected from the group consisting of butyl nicotinate dimethyl sulfate quaternary, butyl nicotinate methyl methane sulfonate quaternary, butyl nicotinate diethyl sulfate quaternary, and butyl nicotinate p-methyl tosylate quaternary.

8. A process for depositing a bright, smooth, adherent zinc plating on a substrate, which comprises a step of electrodepositing zinc from an aqueous non-cyanide zinc electroplating bath as defined in claim 1.

* * * * *